US005649694A

United States Patent [19]

Buck

[11] Patent Number: 5,649,694

[45] Date of Patent: Jul. 22, 1997

[54] MULTIPLE JAW VISE WITH FLOATING ACTUATOR

[76] Inventor: James R. Buck, 1207 SE. 10th St., Cape Coral, Fla. 33904

[21] Appl. No.: 447,764

[22] Filed: May 23, 1995

[51] Int. Cl.[6] ..... B25B 1/10

[52] U.S. Cl. ..... 269/43; 269/242; 269/279; 269/283; 269/154

[58] Field of Search ..... 269/242, 246, 269/43, 153, 279, 280, 282, 283, 152, 906, 154

[56] References Cited

U.S. PATENT DOCUMENTS

| | | | |
|---|---|---|---|
| 2,490,843 | 12/1949 | Sordi | 269/279 |
| 2,880,638 | 4/1959 | Muggli et al. . | |
| 4,043,547 | 8/1977 | Glomb et al. . | |
| 4,192,521 | 3/1980 | Smith | 269/242 |
| 4,529,183 | 7/1985 | Krason et al. . | |
| 4,688,779 | 8/1987 | Dornfeld . | |
| 4,934,674 | 6/1990 | Bernstein . | |
| 5,022,636 | 6/1991 | Swann . | |
| 5,098,073 | 3/1992 | Lenz . | |
| 5,129,638 | 7/1992 | Durfee | 269/282 |
| 5,160,127 | 11/1992 | Lin . | |
| 5,351,943 | 10/1994 | Milz | 269/242 |
| 5,374,040 | 12/1994 | Lin . | |

FOREIGN PATENT DOCUMENTS

| | | |
|---|---|---|
| 4 430 673 | 3/1995 | Germany . |
| 89/11950 | 12/1989 | WIPO . |

*Primary Examiner*—Robert C. Watson
*Attorney, Agent, or Firm*—Flynn, Thiel, Boutell & Tanis, P.C.

[57] ABSTRACT

A vise with first and second movable jaws slidable on elongate ways on a base. An actuator shaft extends longitudinally of the base and has first and second reversely threaded portions threadably engaged with the respective first and second movable jaws. A releasable retraining device cooperates between the base and the second jaw to restrain slidable movement thereof. The actuator shaft is axially floatable supported relative to the base and when rotated in one direction causes the first jaw to move in a first direction along the ways. The restraining device prevents slidable movement of the second jaw so that rotation of the actuator shaft causes the shaft to be axially displaced due to its threaded engagement with the second jaw, and this increases the movement rate of the first jaw due to its threadable engagement with the actuator shaft. When the first jaw encounters an obstruction preventing further movement, such as a workpiece, the restraining device releases so that continued rotation of the shaft causes the second jaw to move until it also encounters an obstruction such as a workpiece, and thereafter continued rotation causes both moving jaws to uniformly grippingly engage the workpiece or workpieces.

17 Claims, 6 Drawing Sheets

MULTIPLE JAW VISE WITH FLOATING ACTUATOR

FIELD OF THE INVENTION

This invention relates to a work holding apparatus for clamping a workpiece, which apparatus is commonly known as a vise.

BACKGROUND OF THE INVENTION

It is common practice to utilize a vise for securing a workpiece when performing a manufacturing operation on the workpiece. Such as vises are typically utilized on precision machining equipment, such numeric-control equipment, to clampingly hold a workpiece during a defined machining operation. Such vises typically employ a pair of moving jaws and, in many of the prior structures, at least one fixed center jaw so as to permit simultaneous holding of two workpieces to likewise permit a single working station to simultaneously perform machining operations on two different workpieces. The known vises typically utilize a threaded actuator shaft which has reverse threads engaged with both moving jaws to effect simultaneous opposed movements of the two moving jaws toward the fixed center jaw. Alternatively, one of the moving jaws may be connected in a non-threaded manner to the drive shaft so as to move toward the fixed jaw only after the other moving jaw has been moved into a workpiece engaging position with the fixed jaw. While the known vises have generally performed in a satisfactory manner, nevertheless the known vises have generally possessed minimum flexibility with respect to their adaptability to various types of desired machining operations, and/or have operated with a degree of efficiency which is less then desired.

Examples of known vises are shown by the following U.S. Pat. Nos.: 5,022,636, 4,934,674, 5,098,073 and 4,529,183.

In addition to the above, the known vises often have not permitted rapid interchange of jaws, and/or secure holding of the moving jaws against the slides or ways to insure a secure and precision clamping of the workpiece between the jaws.

Other examples of vises and of the structures thereof are shown by the following U.S. Pat. Nos: 2,880,638, 4,043,547, 5,160,127, 4,688,779.

Accordingly, it is an object of this invention to provide an improved vise for permitting secure clamping of a workpiece, such as for permitting machining or other manipulations to be carried out with respect to the workpiece, which vise provides improvements with respect to adaptability and flexibility of use thereof.

Another object of the invention is to provide an improved vise, as aforesaid, which employs a pair of moveable jaws and, in various use configurations, can employ from one to three fixed jaws disposed for cooperation with the movable jaws, which so that a fixed jaw is adapted for simultaneously clamping of two different workpieces, or for clamping either inside or outside peripheries of the workpieces, can be used without a centering support so as to function as a centering-type vise, and can be used with a center fixed piloting jaw so as to be used as a compensating-type vise.

A further object of the invention is to provide an improved vise, as aforesaid, which permits quick and efficient interchanging of the jaws, particularly the moving jaws, and at the same time provides for secure sliding engagement of the moving jaws with the ways at all times.

Still a-further object of the invention is to provide an improved vise, as aforesaid, which incorporates a one-piece rotatable actuator shaft which has a screw-thread connection with each of two oppositely movable jaws, which actuator shaft is axially floatably mounted and cooperates in conjunction with a releasable restraining device associated with only one of the moving jaws so as to permit the moving jaws to be sequentially movably displaced during actuation of the vise.

The vise of this invention, in a preferred embodiment, includes first and second movable jaws slidably supported on elongate ways provided on an elongate base. A rotatable actuator shaft extends longitudinally of the base and has first and second reversely threaded portions which are threadably engaged with the respective first and second movable jaws. A releasable retraining device cooperates between the base and the second jaw to additionally restrain slidable movement thereof. The actuator shaft is axially floatably supported relative to the base and when rotated in one direction causes the first jaw to move in a first direction along the ways. The releasable restraining device prevents slidable movement of the second jaw so that the rotation of the actuator shaft causes the shaft to be axially displaced due to its threaded engagement the second jaw, and this in turn increases the movement rate of the first jaw due to the threadable engagement between the actuator shaft and the first jaw. When the first jaw encounters an obstruction preventing further movement, such as a workpiece engaged with a stationary jaw or supported on a pilot member, the restraining device releases so that continued rotation of the shaft causes the second jaw to linearly move in the opposite direction from the movement of the first jaw. The second jaw movement continues until it also encounters an obstruction such as a workpiece, which in this case may be a different workpiece which is also engaged with a stationary jaw, and thereafter continued rotation causes both moving jaws to uniformly grippingly engage the workpiece or workpieces.

The vise of the invention, in the preferred embodiment, has an adjustable nut assembly cooperating between the base and the actuator shaft, with an adjustable nut being adjustably positioned between a first location wherein the shaft can axially float, and a second position wherein the shaft is axially restrained, in which latter position the two movable jaws will be simultaneously activated in opposite directions so as to function as a conventional centering vise for gripping a single workpiece therebetween.

In the vise of this invention, as aforesaid, the vise is preferably provided with up to three fixed jaws removably mounted thereon, with at least one fixed jaw being removably positioned preferably between the two movable jaws so as to permit two workpieces to be simultaneously clampingly held within the vise, one on either side of the center fixed jaw. Two additional fixed jaws can also be provided, one adjacent each end of the vise, so that the two moving jaws are positioned between the two fixed end jaws. This permits two different workpieces to be held within the vise, for example a workpiece can be held between each moving jaw and a respectively adjacent fixed end jaw. The arrangement of fixed and moving jaws enable both interior and exterior surfaces of the workpieces to be suitably gripped.

In an alternate embodiment of the invention, the vise is provided with two fixed jaws disposed in spaced relation, and one moving jaw disposed therebetween. The moving jaw cooperates with one fixed jaw to permit external gripping of a workpiece therebetween, and cooperates with the other fixed jaw to permit internal gripping of a workpiece therebetween.

Other objects and purposes of the invention will be apparent to persons familiar with vises of this general type upon reading the following specification and inspecting the accompanying drawings.

Figure 1:
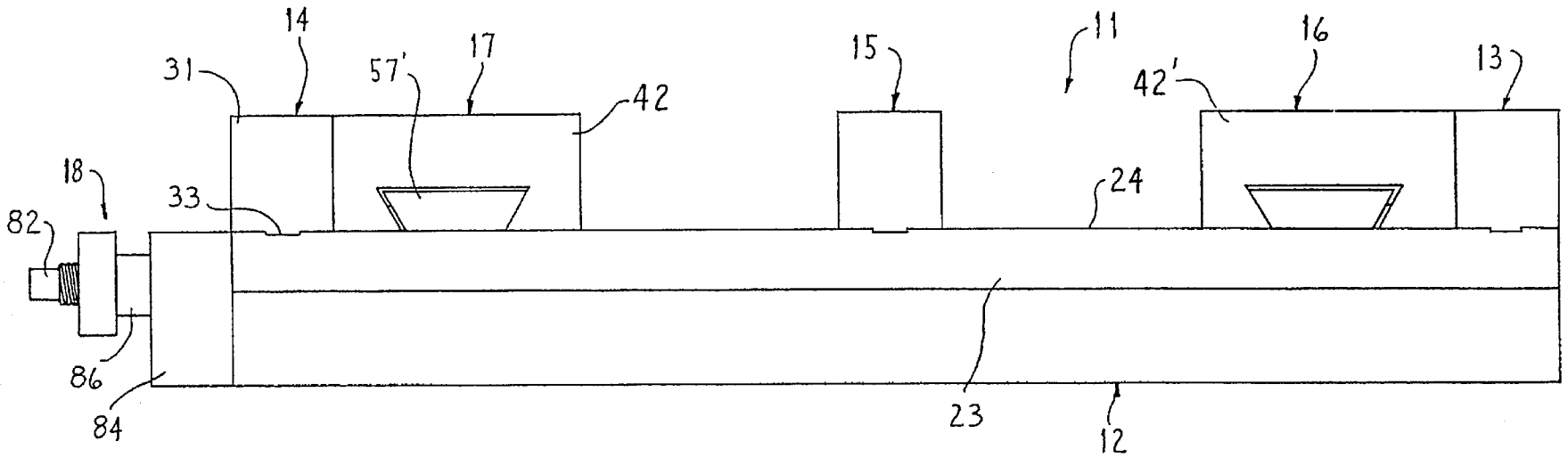
FIG. 1 is plan view of the vise shown in vise according to the present invention.
Figure 2:
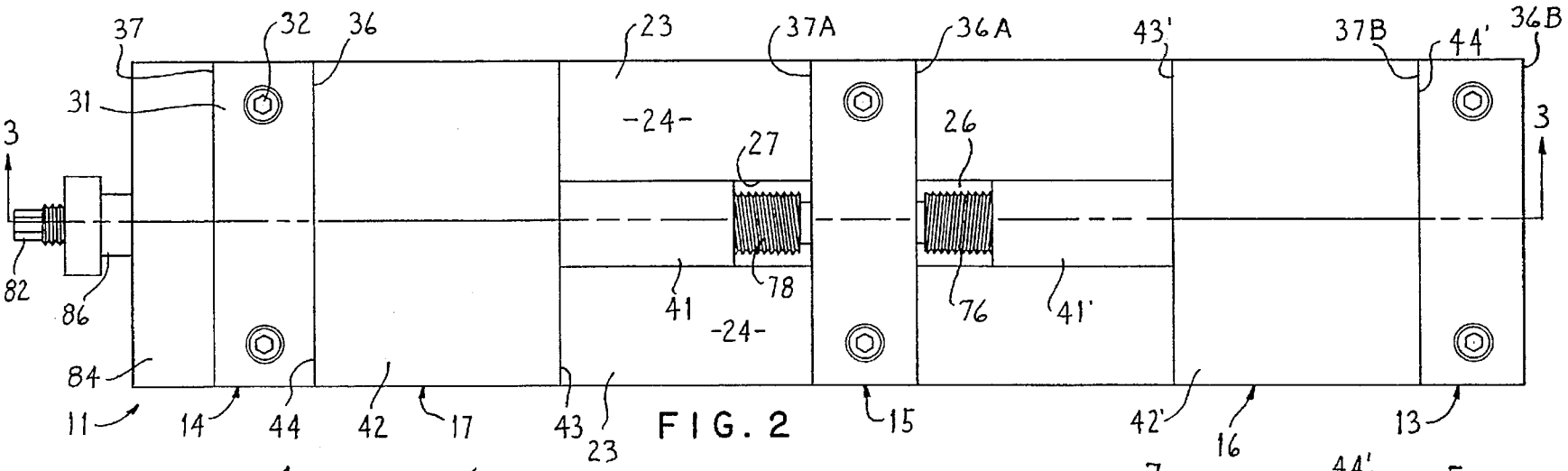
FIG. 2 is a plan view of the vise shown in FIG. 1.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the vise and designated parts thereof. Said terminology will include the words specifically mentioned, derivatives thereof, and words of similar import.

DETAILED DESCRIPTION

Referring to the drawings and specifically FIGS. 1–10, there is illustrated a vise 11 according to the present invention. This vise includes a base structure 12 having a right end fixed jaw 13, a left end fixed jaw 14, a center fixed jaw 15, a right movable jaw assembly 16 and a left movable jaw assembly 17. An actuator assembly 18 is associated with and extends generally longitudinally of the vise for actuating the right and left jaw assemblies 16 and 17.

The base structure 12 includes an elongate U-shaped base member 21 having upwardly projecting side legs 22 which at upper ends thereof have elongate ways or guide elements 23 fixed thereto, the latter defining upper horizontally elongated slide surfaces 24 thereon. The base structure 12 defines therein a longitudinally elongated and upwardly opening guide passage 26, the latter being of a generally inverted T-shaped cross section and-opening upwardly between the parallel ways 23. The ways define thereon opposed guide surfaces 27 which define opposite sides of the upper portion of the guide passage 26, and the bottom of this guide passage is defined by a bottom guide surface 28 formed on the base member 21.

Considering the structure of the left fixed jaw 14, it includes a block-like jaw member 31 which extends transversely across the base member and is supported on and projects upwardly from the ways 23, with the jaw member 31 being removably fixed to the base structure by fasteners, such as screws 32. The jaw member 31 also has, on the lower surface thereof, a downwardly projecting and transversely extending keypart which projects into a shallow keyway 33 formed in and extending transversely of the ways 23 to assist in the fixed securement of the jaw 14 to the base structure.

The fixed jaw 14 has a workpiece gripping surface 36 formed on one side thereof, with an additional gripping surface 37 preferably also being formed on the opposite side thereof. While these gripping surfaces 36 and 37 are illustrated as planar in FIGS. 2 and 3, it will be appreciated that this is solely for convenience in illustration, and that the gripping surfaces may be provided with whatever contour is desired so as to generally correspond with the configuration of the workpiece surface being gripped. The gripping surfaces can additionally be provided on separate removable jaw plates which attach to the jaw member 31 if desired, such removable jaw plate being diagrammatically illustrated by dotted line 38 in FIG. 3.

The right end fixed jaw 13 and the center fixed jaw 15 are of generally similar construction to the left end fixed jaw 14, and they attached to the base structure in generally the same fashion, so that further detailed description of the jaws 13 and 15 is believed unnecessary. These latter jaws are also disclosed as possessing-gripping surfaces on opposite sides thereof, these being designated at 36A and 37A on the center jaw 15, and at 36B and 37B on the right fixed jaw 13.

Considering now the structure of the left movable jaw assembly 17, it includes a bottom or master jaw member 41 which is slidably supported generally within the inverted T-shaped guide passage 26, and this bottom jaw member in turn removably mounts thereon a top jaw member 42. This top jaw member 42 defines thereon jaw gripping surfaces 43 and 44 on opposite sides thereof, which surfaces are again illustrated as planar but can obviously be configured as desired so as to more closely conform with the shape of the workpiece surface being gripped. These jaw gripping surfaces can also be provided on removable jaw face plates if desired.

The top jaw member 42 is positioned to extend above the ways 23 and extends transversely across the base structure, and adjacent opposite ends thereof are provided with generally coplanar bottom surfaces 46 which are slidably supported on the upper way surfaces 24. The top member 42 also has a guide or keypart 47 which is disposed between the bottom surfaces 46 and projects downwardly a limited extent, this keypart being slidably accommodated between the opposed guide surfaces 27 so as to provide transverse constraint relative to the top jaw member 42.

The top jaw 42 defines therein a guide slot 49 which is elongated transversely thereacross, and which opens outwardly through both the bottom of the top jaw member 42 and also outwardly through at least one and preferably both end surfaces thereof. This guide slot 49 preferably has a generally dovetail-shaped cross section as defined between opposed side walls 51 and 52 which project upwardly from the bottom of the top jaw member and which not only diverge with respect to one another, but also diverge away from the vertical, preferably at an angle of 30°. These diverging side walls 51 and 52 in turn are joined by a generally horizontally extending top wall 53 which defines the closed end of the guide slot 49.

As to the master or bottom jaw member 41, it includes a base part 56 which is elongated in the longitudinal direction of the base structure and has a generally inverted T-shaped cross section so as to be snugly but longitudinally slidably disposed within the inverted T-shaped guide passage 26. This elongate base part 56 in turn has a keypart 57 formed integrally thereon and projecting upwardly at the upper end thereof, this keypart 57 having a generally dovetail-shaped cross section when viewed in a vertical longitudinal plane. The keypart 57 is defined by side walls 58 and 59 which project upwardly from a top wall 61 of the base part 56, with these side walls 58 and 59 diverging outwardly relative to one another and relative to the vertical as they project upwardly. These side walls 58 and 59 at their upper ends are in turn joined by a generally horizontally extending top wall 62. The angle and divergence of the keyway side walls 58 and 59 is generally the same as the angle and divergence of the guide slot side walls 51 and 52 so that the dovetail-shaped keyway 57 will hence be readily transversely slidably accommodated within the dovetail-shaped guide slot 49. The overall height and width of the guide slot 49, however, will be slightly greater than the corresponding height and width of the keyway 57 to provide sufficient clearance so that the top jaw 42 can be slidably moved transversely over the way surface 24 into engagement with the keyway 57 until the bottom guide part 47 on the top jaw member 42 passes over the way surface 24 so as to be aligned over and then moved downwardly for positioning between the opposed guide surfaces 27. When so disposed, the bottom surfaces 46 on the top jaw 42 are engaged with the way surfaces 24, and a combined clearance distance is defined perpendicularly between the opposed side walls 51, 58 and 52, 59 which clearance distance is at least equal to the vertical extent that keyway 47 projects downwardly below bottom surfaces 46.

The dovetail keypart 57 mounts thereon a resilient takeup assembly 63 so as to insure that the top jaw member 42 is appropriately cammed inwardly and downwardly for secure contacting engagement with one side of the keyway (such as side 59 in FIG. 8) as well as the upper way surfaces 24. This takeup assembly includes a takeup member 64 which is movably disposed within a bore 65 formed in the keypart 57, which bore opens inwardly through one of the diverging side surfaces, such as surface 58 in FIG. 8. A resilient device such as a spring 66 is accommodated within the hollow sleeve part of the takeup member 64 and cooperates between the takeup member and the rear wall of the bore so as to resiliently urge the takeup member 64 outwardly so that the nose end 67 thereof is maintained in engagement with the opposed side wall of the guide slot, such as the side wall 51 in FIG. 8. A stop 68 is mounted on the keypart 57 and projects into an elongate slot 69 formed in the takeup member for limiting the travel of the takeup member and preventing accidental separation thereof from the keypart.

The nose end 67 of the take up member 64 has a contact surface 71 thereon which extends in parallel relationship to the opposed side wall 51 and hence is maintained in generally slidable contact therewith. The nose end in addition has relief corners or tapers 72 formed on opposite sides of the contact surface 71 which corners or tapers 72 effectively function as cams so as to facilitate the transverse insertion of the keypart 57 into the guide slot 49.

Figure 7:
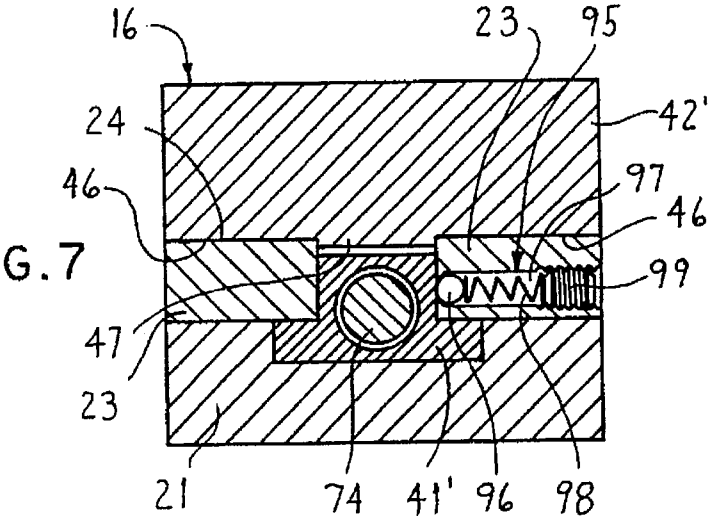
Figure 8:
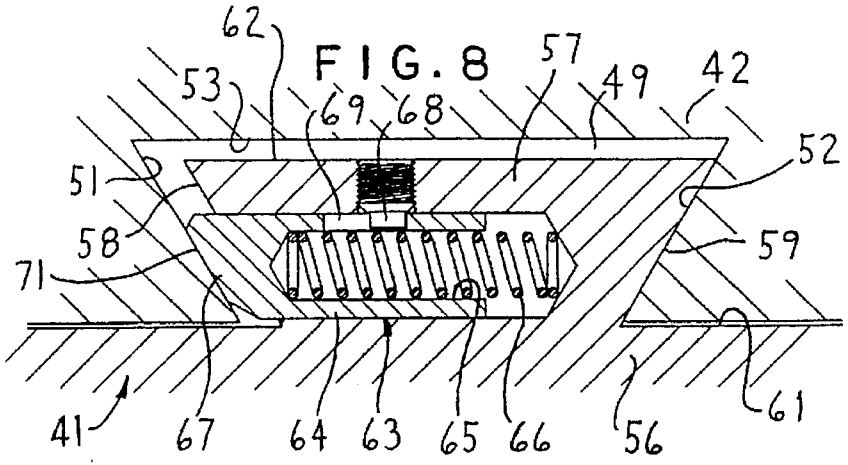
FIG. 8 is an enlarged, fragmentary sectional view illustrating the connection between the top and base jaw members of the movable jaw assembly.
Figure 9:
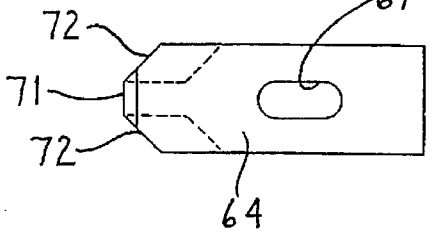
FIG. 9 is a top view of the take up member.

The resilient takeup assembly 63 and the manner in which the takeup member 64 is spring-urged into engagement with the tapered side wall 51 causes the upper jaw member 42 to both be urged longitudinally sidewardly so that the opposite diverging side wall 52 is maintained in engagement with the opposed keypart side wall 59, and at the same time the diverging relationships insure that the top jaw member 42 is pulled downwardly for snug engagement between the bottom surfaces 46 and the upper way surfaces 24 as illustrated in FIG. 7.

The right movable jaw assembly 16 is substantially identical to the jaw assembly 17 described above except that the jaw assemblies 16 and 17 are basically mirror images of one another relative to the center of the vise, such as relative to the center fixed jaw 15. The top and bottom jaw members of the jaw assembly 16 are respectively designated 42' and 41' so as to otherwise distinguish them from the corresponding parts of the jaw assembly 17. The top jaw member 42' additionally has gripping surfaces 43' and 44' defined on opposite sides thereof.

Considering now the actuator assembly 18, there is provided an elongate actuator shaft 74 rotatable about its longitudinal axis 75, the latter extending longitudinally of the base structure in generally parallel relationship with the way surfaces 24. The actuator shaft is disposed generally within and extends longitudinally along the guide passage 26 and includes thereon a first externally threaded part 76 which extends through a bore 77 formed in the bottom jaw member 41'. At least a part of this bore 77 is internally threaded and maintained in threaded engagement with the threaded shaft part 76. In similar fashion, the shaft 74 has a further externally threaded part 78 which is spaced axially from the threaded part 76 and which extends through a further bore 79 formed in the bottom jaw member 41. At least part of this bore 79 is also internally threaded and is maintained in threaded engagement with the threaded shaft part 78. The threaded shaft parts 76 and 78, as well as the associated threaded bores, are reversely threaded in that one is a right-hand thread and the other a left-hand thread so that movement of the lower jaw members 41' and 41 relative to the rotating shaft 74 is in opposite linear directions.

The actuator shaft 74, at one end thereof (the leftward end in FIGS. 1–3) includes an elongate shaft part 81 which projects outwardly beyond the base structure and at its free end terminates in an actuator part 82, the latter being of non-circular cross section such as square or hexagonal so as to accommodate thereon a driving wrench or socket for permitting rotating of the shaft 74 when desired.

An adjustment structure 83 cooperates between the elongate shaft part 81 and the base structure 12 for both assisting in the rotatable support of the shaft, and at the same time selectively supporting the shaft either for free axial floating movement or axially restraining the shaft relative to the base structure. This adjustment structure 83 includes an adjustment plate 84 which overlaps and is fixedly secured to the end of the base structure, and has an opening 85 therethrough which provides rotatable support for the elongate shaft part 81. The adjustment structure also includes an adjusting sleeve or nut 86 which surrounds the projecting shaft part, this adjustment sleeve 86 being internally threaded and maintained in threaded engagement with an externally threaded portion 87 of the shaft part 81. The sleeve 86 has a generally cylindrical exterior configuration which is slidably accommodated within an enlarge cylindrical bore 88 formed in the adjustment plate 84 in coaxial alignment with the opening 85. This bore 88 at its inner end terminates in an end wall or shoulder 89.

The actuator shaft 74 is also provided with an enlarged hub or shoulder 93 which is disposed in opposed and facing relationship to, but is typically spaced inwardly away from, the inner surface 94 of the adjustment plate 84.

The adjusting sleeve 86 preferably has an enlarged flange or hub 91 at the outer end thereof to facilitate engagement or gripping of the nut, either manually or by means of a tool, when rotational adjustment of the nut is desired.

One of the moving jaw assemblies, specifically the right jaw assembly 16, also has a releasable restraining device 95 (FIG. 7) associated therewith. This device, in the illustrated embodiment, includes a restraining member 96 such as a ball, pin or other suitable plunger member, movably disposed within a bore 97 which extends transversely through the way 23 so that the bore opens adjacent one side of the lower jaw member 41'. The restraining member 96 is disposed at the inner end of the bore 97 for contact with a side wall of the lower jaw member 41', and a spring 98 cooperates between the restraining member 96 and an adjustable stop 99 for normally urging the restraining member into frictional contact with the side wall of the base jaw member 41'. This restraining device 95 imposes additional frictional force against the base member 41' to hence restrain the movement of the jaw assembly 16 relative to the base structure, at least by increasing the amount of breakaway frictional force which must be overcome in order to initiate sliding movement of the jaw assembly 16. It should be noted that the other movable jaw assembly 17 does not have a similar restraining device associated therewith, and hence the initial breakaway restraining friction on the moving jaw assembly 17 is significantly less than that imposed on the movable jaw assembly 16. Jaw assembly 17 thus will more easily and initially slide in comparison to the jaw assembly 16. The purpose of this restraining device and its effect on the overall operation will be apparent from the operational description set forth hereinafter.

While one form of frictional restraining device has been shown as illustrated in FIG. 7, it will be appreciated that numerous other types of restraining devices including frictional leaf springs and the like could also be utilized for increasing the frictional drag and hence increasing the frictional breakaway force for the jaw assembly 16.

The various modes of operation of the vise 11 of this invention will now be briefly described to insure a more complete understanding of the invention. In this respect, reference is made to FIGS. 11, 12, 14 and 15 which illustrate some of the different modes of operation of this vise, and hence the overall adaptability and flexibility thereof.

Figure 10:
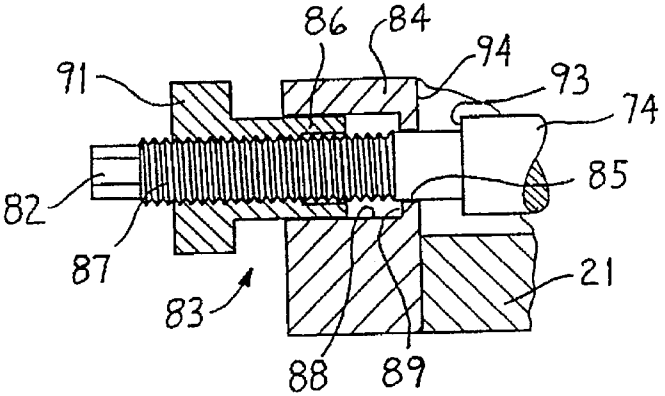
FIG. 10 is an enlarged fragmentary sectional view showing the adjusting nut assembly for the floatable actuator shaft.
Figure 11:
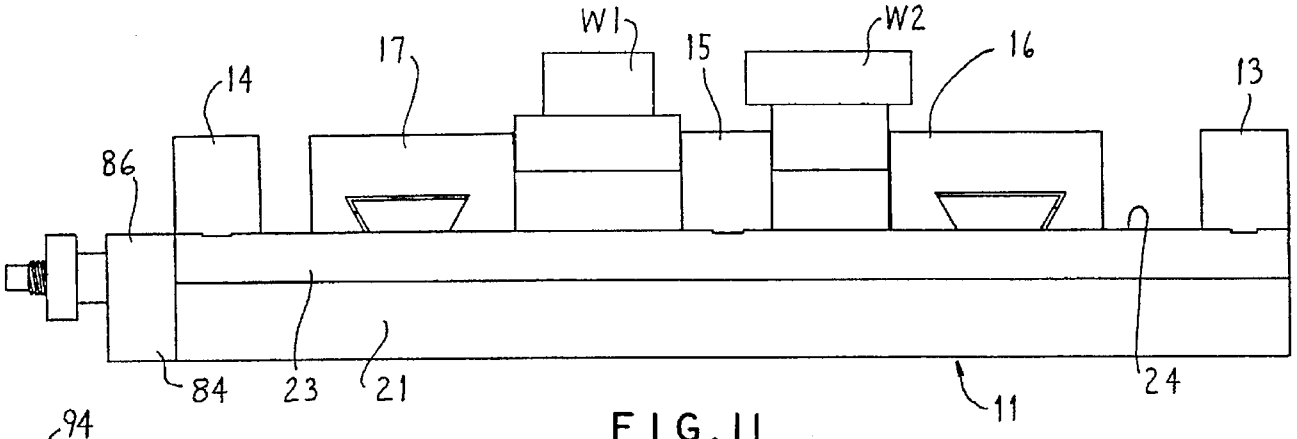
FIG. 11 is a side elevational view illustrating the vise in clamping engagement with two different workpieces disposed on opposite sides of a fixed center jaw.

Referring to FIG. 11, there is diagrammatically illustrated use of the vise 11 for simultaneous clamping of two workpieces which are diagrammatically illustrated at W1 and W2. One workpiece W1 is adapted to be clamped between the moving jaw 17 and the center fixed jaw 15, and the other workpiece W2 is clamped between the center fixed jaw 15 and the other movable jaw 16. In use of the vise, and assuming the vise is in an open position as illustrated approximately by FIGS. 1–3, and with the actuator shaft 74 in an axial floating mode as permitted by the adjusting structure 83 being disposed substantially as illustrated by FIG. 10, the actuator shaft 74 is rotated in a direction to cause the jaw 17 to advance toward the center fixed jaw 15. During this rotation of the actuator shaft 74, however, the restraining device 95 exerts sufficient frictional force on the other jaw 16 as to resist movement thereof. The rotation of shaft 74 hence causes the shaft to be moved axially and thread into the lower jaw member 41'. This axial inward movement of the shaft 74, coupled with the rotation of the shaft and its threaded connection to the jaw 17, hence causes solely the jaw 17 to be moved inwardly toward the jaw 15 at a rate which is twice the rate caused by the threaded connection between the shaft and jaw.

This inward movement of jaw 17 continues until it comes into contact with the workpiece W1 such that the workpiece W1 is lightly gripped between jaw 17 and jaw 15. Since further inward movement of jaw 17 is now restrained, continued rotation of shaft 74 now overcomes the frictional restraint imposed by restraining device 95, whereby jaw 16 is now moved inwardly toward jaw 15 due to the reverse threaded engagement of this jaw with the shaft 74. At the same time, the continued rotation of the shaft 74 and its threaded engagement with lower jaw member 41 causes the shaft 74 to be displaced rearwardly (leftwardly) which compensates for the tendency of the jaw 17 to continue to move forwardly along the shaft, thereby maintaining the jaw 17 stationary and in light gripping engagement with the workpiece W1. This continues until the jaw 16 contacts and effects light gripping of the workpiece W2 between the jaws 15 and 16. At this point both jaws 16 and 17 are effectively restrained from further movement. Continued rotation of the shaft 74 acting through the threaded engagement with the jaw assemblies 16 and 17 thus causes the jaw assemblies 16 and 17 to exert substantially equal pressures against the respective workpieces to effect clamping of the two workpieces between the three jaws in the manner diagrammatically illustrated in FIG. 11.

With the workpieces so clamped, two simultaneous machining operations can be carried out, such as on a machining center, since both workpieces W1 and W2 can have different machining operations carried out simultaneously. Further, if the workpieces W1 and W2 are identical and require machining operations to be performed on different sides, such as on opposite ends, this hence-enables a single machining cycle to, in effect, perform a machining operation comparable to machining of the entire workpiece. Upon completion of the machining operation, shaft 74 is reversely rotated and this causes initial loosening of the jaw 17. After the jaw has moved a small distance away from the workpiece, which away movement of the jaw 17 is also accompanied by a leftward axial movement of the shaft 74, the shoulder 93 on shaft 74 abuts the stop surface 94 so that further shaft rotation then causes both jaws 17 and 19 to be simultaneously moved outwardly away from the respective workpieces so as to permit removal of the workpieces and permit initiation of a new cycle of operation.

When used for carrying out simultaneous machining of two workpieces in the manner described above and illustrated in FIG. 11, it will be observed that only a single fixed center jaw 15 is required, and the end fixed jaws 13 and 14 are either not utilized or can be eliminated.

As a further variation of dual workpiece gripping, the vise can be used as a four-jaw vise employing the moving jaws 16 and 17 and the fixed end jaws 13 and 14, with the fixed middle jaw 15 in this variation either being eliminated or not utilized. In this four-jaw variation, the workpiece W1 is gripped between the jaws 14 and 17, and the other workpiece W2 is gripped between the jaws 16 and 13. The sequential operation of the jaws 17 and 16, and the corresponding axial movement of the actuator shaft 74, as described above relative to the three-jaw embodiment of FIG. 11, is basically the same so that further detailed description thereof is believed unnecessary.

Figure 3:
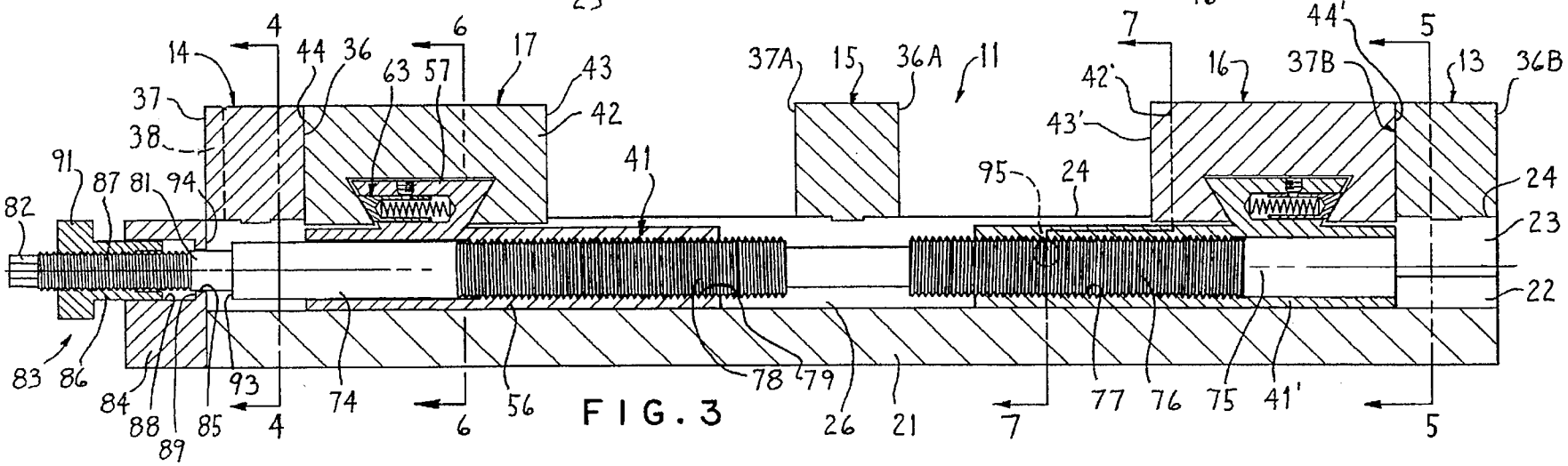
FIG. 3 is a longitudinally extending central sectional view taken generally along line 3—3 in FIG. 2.
Figure 6:
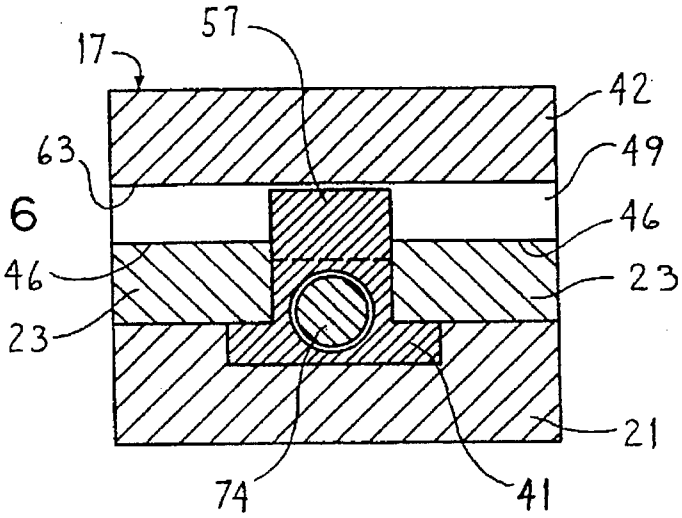
FIGS. 4, 5, 6 and 7 are sectional views taken respectively along lines 4—4, 5—5, 6—6 and 7—7 in FIG. 3.
Figure 5:
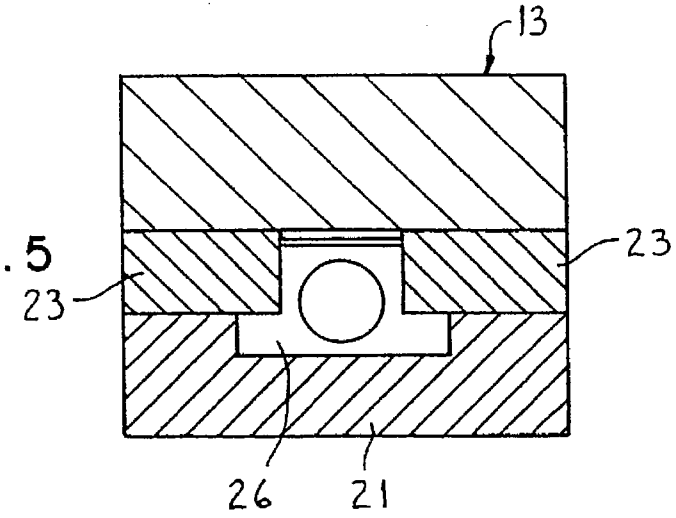
Figure 4:
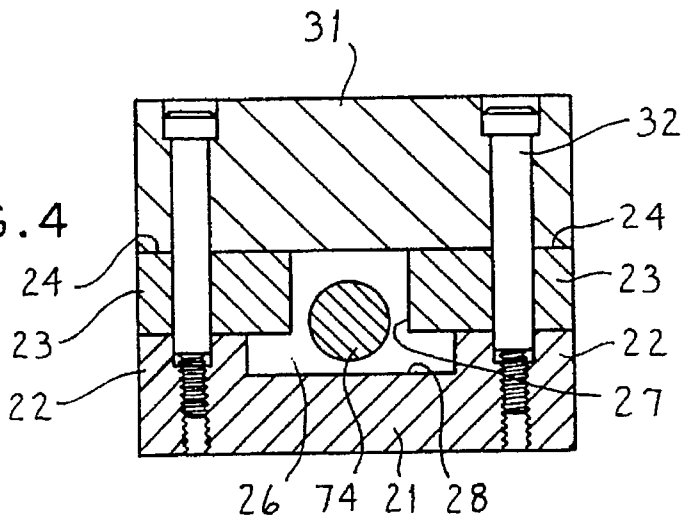
Figure 12:
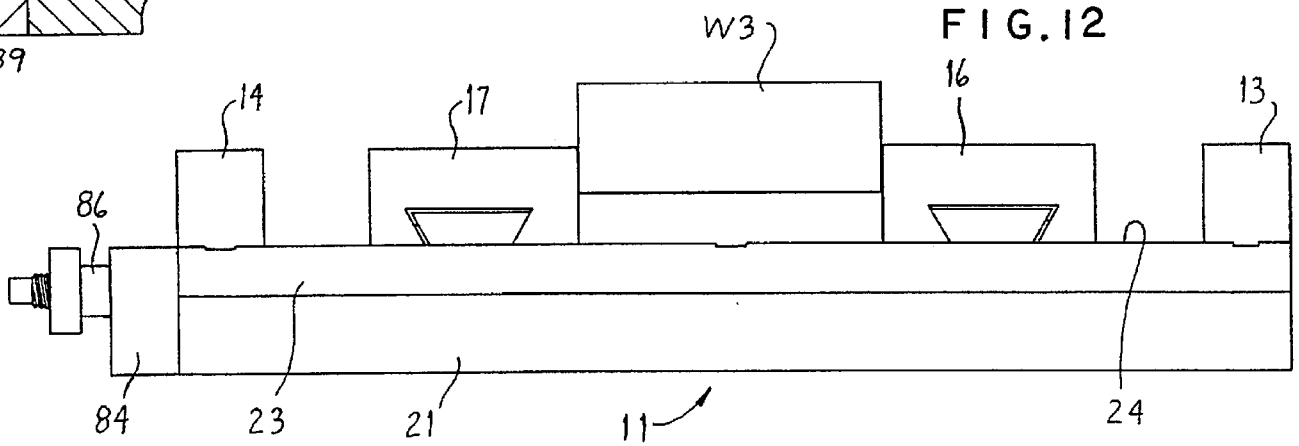
FIG. 12 is a similar view illustrating the vise used as a self-centering vise wherein the center jaw is removed so as to permit gripping of a workpiece directly between the two moving jaws.
Figure 13:
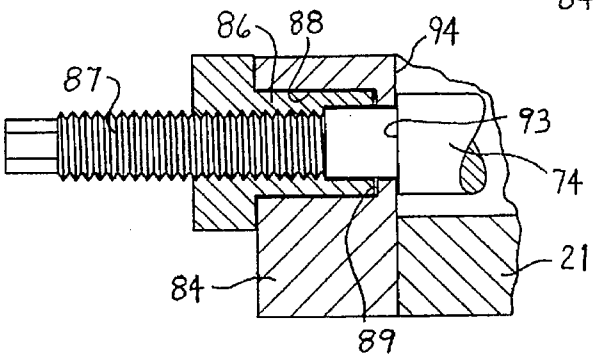
FIG. 13 is a fragmentary sectional view showing the adjustment nut which axially secures the actuactor shaft when the vise used as a centering vise as in FIG. 12.

Referring now to FIG. 12, there is illustrated a mode of use of the vise 11 of this invention which is basically a two-jaw vise, namely two moving jaws, whereby the vise functions as a self-centering-type vise for permitting a single workpiece to be uniformly gripped directly between the opposed moving jaws 16 and 17. In this variation, the center fixed jaw 15 is removed, and the end fixed jaws 13 and 14 are either removed or are not utilized. In addition, the adjusting nut 86 is manually rotated onto the threaded shaft portion 87 so that the nut 86 is pulled into the bore 88 so as to substantially abut the end shoulder 89 thereof, and to also cause the shaft 74 to be pulled leftwardly so that the shoulder 93 thereon abuts the inner plate surface or stop 94, substantially as illustrated by FIG. 13. This prevents axial floating movement of the shaft 74, the latter hence being solely rotatable. With the shaft restrained solely for rotation, this causes the two jaws 16 and 17 to be simultaneously and equally linearly displaced toward one another so as to permit gripping of the workpiece W3 therebetween substantially as illustrated by FIG. 3. This mode of operation hence generally corresponds to a substantially conventional two-moving-jaw chuck.

Figure 14:
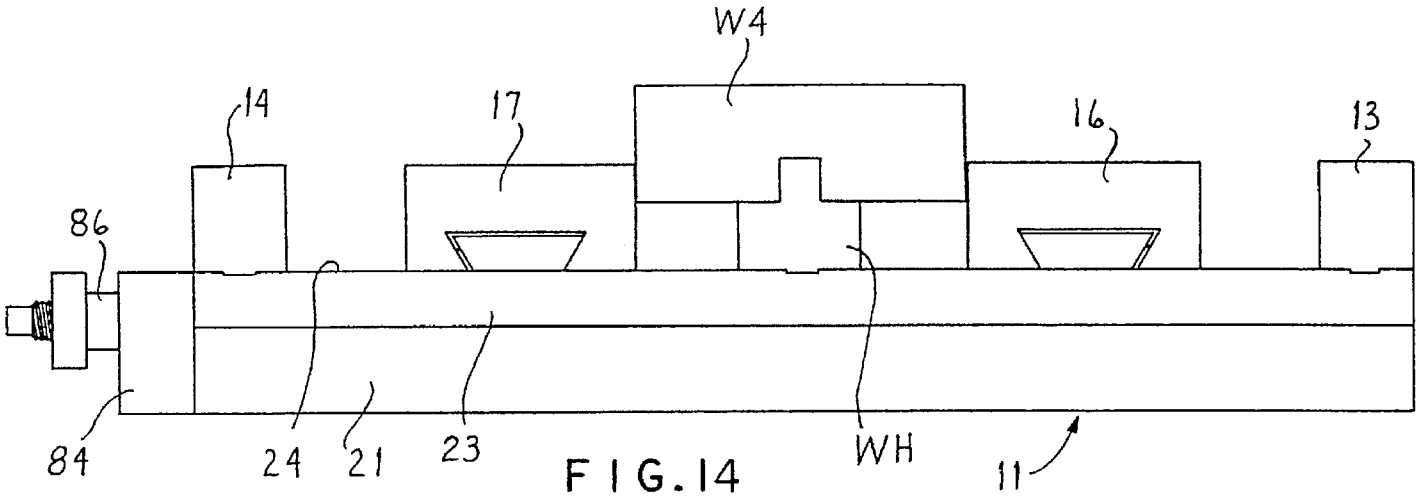
FIG. 14 is a view similar to FIG. 11 but showing the fixed center jaw removed and replaced with a work support pilot which enables a workpiece to be engaged in a compensating fashion directly between the movable jaws.

Referring to FIG. 14, there is illustrated another mode of use of the improved vise 11 of this invention. The mode of use illustrated by FIG. 14 is of the type known as a compensating-type vise. In this mode, only two jaws are required, namely the two moving jaws 16 and 17. A support or pilot device WH is provided, typically fixedly mounted to the base structure in the position of the center fixed jaw 15. Alternately, one or more of the fixed jaws may be used, and modified if necessary, to function as a support or pilot device. The pilot device WH will typically have a pilot-type support for supporting and positioning the workpiece W4 between the moving jaws 16 and 17. In this compensating type mode of use, the actuator shaft 74 will again be in its axial floating mode, as illustrated by the position of the adjusting structure in FIG. 10, and the restraining device 95 will be adjusted (i.e. loosened) so as to impose no significant restraining force on the jaw assembly 17. Thus, during actuation, one of jaws 16 or 17 will initially be moved inwardly into light gripping engagement with one side of the workpiece W4, and thereafter the other jaw will then be moved inwardly to effect light gripping engagement with the opposite side of the workpiece W4, with further rotation of the actuator causing the two jaws 16 and 17 to apply uniform gripping pressure on opposite sides of the workpiece. This actuation, and conversely the release of the workpiece, occurs in substantially the same manner as described above relative to the mode of FIG. 11.

Figure 15:
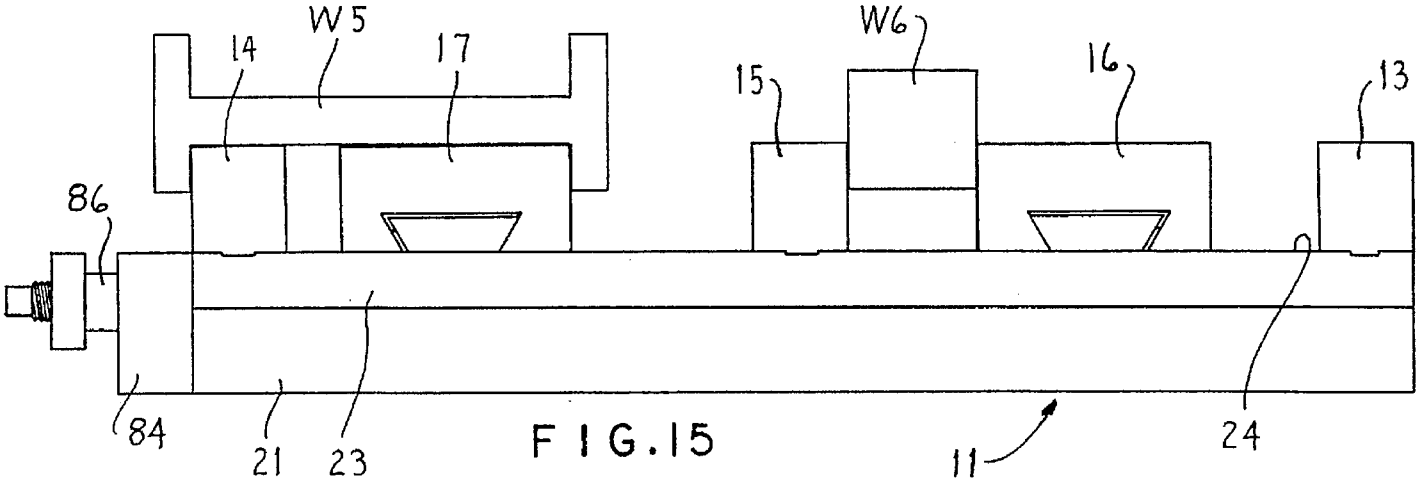
FIG. 15 is a further view of the vise showing engagement with two workpieces, one being in internal surface engagement between a movable jaw and a fixed end jaw, the other being in external engagement between the other movable jaw and a fixed center jaw.

Lastly, reference is made to FIG. 15 which illustrates a further mode of operation of the vise according to the present invention, which mode of operation is similar to the operation of FIG. 11 in that the actuator shaft 74 is again supported for axial floating movement due to the adjusting structure 83 being initially positioned in a manner similar to that illustrated by FIG. 10. In this mode, two workpieces W5 and W6 are again simultaneously gripped. This additionally illustrates, however, that in addition to gripping of the exterior workpiece surfaces between two jaws, such as illustrated by the gripping of workpiece W6 between the jaws 15 and 16, a workpiece can also be gripped by engagement with internal surfaces thereof as illustrated by workpiece W5. In such case, the workpiece W5 is disposed so that opposed interior gripping surfaces thereon engage a pair of gripping surfaces on the moving jaw 17 and the fixed end jaw 14, which gripping surfaces on the two jaws face outwardly in opposite directions with respect to one another. Hence, when the jaw 17 is initially moved inwardly toward the center jaw 15, it will initially contact and effect a light gripping engagement with the workpiece so as to lightly grip the workpiece W5 with the jaws 14 and 17. Continued rotation of the actuator then causes the jaw 16 to-thereafter move inwardly to effect light gripping of the other workpiece W6. Continued shaft rotation then effects uniform tightening of the gripping engagement of all jaws with respect to both workpieces. Both the engaging and releasing of the vise in this embodiment of FIG. 15 hence corresponds generally to the operation described above with respect to FIG. 11.

While FIG. 15 illustrates use of the vise for internal gripping of one workpiece and external gripping of the other workpiece, it will be appreciated that the jaws 16 and 13 could also cooperate for gripping engagement with internal surfaces of a workpiece if desired in the same fashion illustrated by the workpiece W5.

The vise of the invention can also be a three-jaw vise having two fixed and one movable jaws, such as the jaws 14, 15 and 17 of FIG. 15. In such vise, when the movable jaw 17 is moved rightwardly in a gripping direction, a workpiece can be internally gripped between jaws 14 and 17 (as illustrated by W5), or alternatively a workpiece (not shown) can be externally gripped between jaws 15 and 17 in a fashion similar to that illustrated by W6.

While the drawings and specifically FIG. 3 illustrates the resilient take up devices 63 biasing the jaws 16 and 17 outwardly so that the inner gripping surfaces 43 and 43' are best utilized for gripping engagement with a workpiece, it will be appreciated that the axial orientation of the resilient take up devices 63 can be reversed if the opposite gripping surfaces on the jaws, such as the surfaces 44 or 44', are to be utilized for engaging the workpiece. In such case, the top jaw member 42 will be transversely slidably removed from the bottom jaw member, the bottom jaw member will be slidably removed from the end of the base structure and unthreaded from the shaft 74, following which the base jaw member will be reversely axially oriented and then the vise reassembled so that the resilient takeup device 63 will thus be reversely axially oriented from the position illustrated in FIG. 3.

Alternatively, each of the jaws, by having gripping surfaces on opposite axial sides thereof, which gripping surfaces can be provided with different contours to grip different workpieces or workpiece configurations, can be easily disassembled and reversely axially oriented and then reassembled so as to permit the vise to be readily adjusted to accommodate different workpieces without making any significant change in the vise structure or the mode of operation thereof. For example, each of the fixed jaws can be easily unfastened from the base structure and then reversely axially oriented and then reattached to the base structure. Similarly, each of the moving top jaw members can be transversely removed from the respective lower jaw members, reversely axially oriented, and then reassembled.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A vise for gripping at least one workpiece, comprising:

an elongate base defining thereon a slide way which is elongated longitudinally of said base;

first and second longitudinally-spaced jaw assemblies slidably mounted on said way for movement longitudinally of said base;

an elongate actuator shaft rotatably and axially movably supported on said base and extending in the longitudinal direction thereof, said shaft having first and second threaded shaft portions respectively disposed in threaded engagement with said first and second jaw assemblies, said first and second threaded portions being reversely threaded to cause said first and second jaw assemblies to move in opposite directions in response to rotation of said shaft in one rotational direction; and a releasable restraining member engaged between said base and said second jaw assembly for increasing the resistance of said second jaw assembly against movement relative to the resistance of said first jaw assembly against movement.

2. A vise according to claim 1, including adjusting means cooperating between said base and said shaft and movable between a first position permitting axial floating movement of said shaft through at least a predetermined amount and a second position preventing axial movement of said shaft.

3. A vise according to claim 2, wherein said adjusting means includes a part disposed at one end of said base, said shaft having an end portion which projects outwardly beyond said part, and said adjusting means including an adjusting nut threadedly engaged to said end portion and disposed for movement axially toward and away from said part, said shaft also defining thereon a stop surface disposed on the opposite axial side of said part from said adjusting nut and positioned for abutting engagement with said part for limiting axial floating movement of said shaft in one direction, said nut being adapted to abut said part for limiting axial floating movement of said shaft in the opposite axial direction.

4. A vise according to claim 1, including a first stationary jaw fixed to said base at a position between said first and second jaw assemblies.

5. A vise according to claim 4, including a second stationary jaw fixed to said base adjacent one end thereof so that one of said first and second jaw assemblies is disposed between said first and second stationary jaws.

6. A vise according to claim 1, including first and second stationary jaws fixedly mounted on said base adjacent opposite ends thereof so that said first and second jaw assemblies are disposed therebetween.

7. A vise according to claim 6, including a third stationary jaw fixed to said base at a location between said first and second jaw assemblies.

8. A vise according to claim 1, including a pilot fixedly mounted relative to said base for supporting thereon a workpiece which is positioned between said first and second jaw assemblies for enabling said first and second jaw assemblies to engage opposite peripheral parts of said workpiece.

9. A vise according to claim 1, wherein said base includes a pair of said ways disposed in sideward and parallel relationship, said base also defining therein a guide passage which is defined between said ways and extends longitudinally of said base, said actuator shaft being disposed within and extending longitudinally along said guide passage; and each said first and second jaw assembly including a bottom jaw member movably positioned within said guide passage and threadably engaged with the respective threaded shaft portion, and a top jaw member which is slidably supported on said ways and is fixedly but releasably joined to the respective bottom jaw member by a connecting structure.

10. A vise according to claim 9, wherein said connecting structure includes a connecting passage formed in and extending between opposite side surfaces of said top jaw member, said connecting passage extending transversely with respect to said longitudinal direction and opening downwardly through a bottom surface of said top jaw member, said bottom surface having side surface parts which slidably engage said ways, said connecting passage having a generally dovetail-shaped cross section with said cross section being narrowest where it opens through said bottom surface;

said connecting structure including a keypart which is fixed to said bottom jaw member and projects upwardly above said ways into the connecting passage of the respective top jaw member, said keypart having a dovetail-shaped cross section which corresponds to but is slightly smaller than the dovetail-shaped cross section of said connecting passage; and a resilient takeup device mounted on said keypart and including a takeup member movably mounted on said keypart and spring-urged outwardly for engagement with one inclined side surface of said connecting passage for eliminating clearance adjacent the opposite inclined side surface of said connecting passage and for causing the top jaw member to snug down against the way.

11. A vise according to claim 1, wherein each said first and second moving jaw assemblies include a bottom jaw member movably positioned on said base and threadably engaged with the respective threaded shaft portion, and a top jaw member which is slidably supported on said slide way and is fixedly but releasably joined to the respective bottom jaw member by a connecting structure;

said connecting structure includes a connecting passage extending transversely of said top jaw member and opening downwardly through a bottom surface thereof, said connecting passage having a generally dovetail-shaped cross section with said cross section being narrowest where it opens through said bottom surface, and a keypart which is fixed to said bottom jaw member and projects upwardly into the connecting passage of the top jaw member, said keypart having a dovetail-shaped cross section which corresponds to but is slightly smaller than the dovetail-shaped cross section of said connecting passage; and a resilient takeup device mounted on said keypart and including a takeup member movably mounted on said keypart and spring-urged outwardly for engagement with one inclined side surface of said connecting passage for eliminating clearance adjacent the opposite inclined side surface of said connecting passage and for causing the top jaw member to snug down against the slide way.

12. A vise for gripping a workpiece, comprising:

an elongate base defining thereon a pair of generally parallel and sidewardly spaced ways having upper slide surfaces which are elongated longitudinally of said base, and a guide passage which opens downwardly between said slide surfaces and is elongated longitudinally of said base;

first and second jaw structures mounted on said base for permitting gripping of a workpiece therebetween, at least one said jaw structure being longitudinally movably supported on said base and slidable along said ways for movement toward and away from the other jaw structure;

an elongate actuator shaft rotatably supported on said base and extending longitudinally along said guide passage and threadably coupled to said one jaw structure for effecting slidable movement thereof along said ways;

said one jaw structure including a bottom jaw member which is longitudinally movably disposed within said guide passage and has a bore formed therein in said longitudinal direction for accommodating said actuator shaft therein, and a top jaw member which is disposed above and is slidably supported on said ways and is fixedly but releasably joined to the bottom jaw member by a connecting structure; and said connecting structure including a connecting passage of dovetail-shaped cross section extending through said top jaw member transversely with respect to said longitudinal direction and opening downwardly through a bottom surface thereof, and a keypart of longitudinal dovetail-shaped cross section projecting upwardly from said bottom jaw member and being transversely slidably accommodated within said connecting passage, the dovetail-shaped cross sections of said connecting passage and said keypart being generally the same and having the widest cross section at upper ends thereof but with said keypart being of slightly smaller cross section than said connecting passage; and a resilient takeup device mounted on said keypart and coacting resiliently in the longitudinal direction between said keypart and one side of said connecting passage.

13. A vise according to claim 12, wherein said top jaw member has a downwardly projecting guide part which is disposed between side bottom surface portions of said bottom surface and which projects downwardly into said guide passage between said ways for preventing sideward displacement of said top jaw member as it is slidably displaced longitudinally along said ways.

14. A vise according to claim 13, wherein said guide part has a height which is no greater than the combined clearance between opposed side walls of said connecting passage and said keypart when in an assembled condition.

15. A vise according to claim 12, wherein said connecting passage and said keypart in longitudinal cross section are each defined by a pair of longitudinally spaced side walls which are inclined relative to the vertical and which converge with respect to one another as they project downwardly, and wherein said resilient takeup device includes a bore formed in said keypart, a spring disposed within said bore and acting against a takeup member movably accommodatably in said bore and projecting outwardly through one of said side walls of said keypart for engagement with an opposed adjacent side wall of said connecting passage.

16. A vise for gripping a workpiece, comprising:

an elongate base defining thereon a pair of generally parallel and sidewardly spaced ways which extend longitudinally of said base, and a channel-like guide passage which is disposed between said ways and extends longitudinally of said base;

first and second stationary jaws mounted on said base and projecting upwardly from said ways in longitudinally spaced relationship, said first stationary jaw defining thereon a first gripping surface which faces toward said second stationary jaw, and said second stationary jaw defining thereon a second gripping surface which faces away from said first stationary jaw;

a movable jaw slidably mounted on said ways and projecting upwardly therefrom at a location between said first and second stationary jaws, said movable jaw defining thereon a third gripping surface which faces toward said first gripping surface, whereby external peripheral surface portions of a workpiece can be gripped between said first and third gripping surfaces, or alternatively internal peripheral surface portions of a workpiece can be gripped by said second and third gripping surfaces, said movable jaw including a bottom jaw member movably positioned within said guide passage, and a top jaw member which is slidably supported on said ways and is fixedly but releasably joined to the respective bottom jaw member by a connecting structure, said connecting structure including a connecting passage formed in and extending between opposite side surfaces of said top jaw member, said connecting passage extending transversely with respect to said longitudinal direction and opening downwardly through a bottom surface of said top jaw member, said bottom surface having side surface parts which slidably engage said ways, said connecting passage having a generally dovetail-shaped cross section with said cross section being narrowest where it opens through said bottom surface;

said connecting structure including a keypart which is fixed to said bottom jaw member and projects upwardly above said ways into said connecting passage of the respective said top jaw member, said keypart having a dovetail-shaped cross section which corresponds to but is slightly smaller than the dovetail-shaped cross section of said connecting passage;

a resilient takeup device mounted on said keypart and including a takeup member movably mounted on said keypart and spring-urged outwardly for engagement with one inclined side surface of said connecting passage for eliminating clearance adjacent the opposite inclined side surface of said connecting passage and for causing said top jaw member to snug down against said way; and an actuator movably disposed within said guide passage and connected to said movable jaw for effecting slidable movement thereof along said ways in a direction toward said first stationary jaw for permitting gripping of a workpiece between said moving jaw and one of said first and second stationary jaws.

17. A moving jaw assembly for a vise including a master jaw which is movably slidably supported on a base of the vise and removably mounts a top jaw thereon, said top jaw defining at least one workpiece-gripping surface thereon, the improvement wherein said top jaw comprises a one piece jaw member having a pair of flat and coplanar bottom surfaces disposed adjacent opposite ends of said jaw member and separated by an elongate first keypart which is disposed between said bottom surfaces and projects downwardly therefrom through a small extent, and a connecting passage formed in and extending transversely through said jaw member from one side to the other side thereof in perpendicular relation to said elongate first keypart, said connecting passage having a first dovetail-shaped cross section which converges to a mouth which opens through said bottom surfaces, a second keypart which is fixed to said master jaw and projects upwardly into said connecting passage of said jaw member, said second keypart having a second dovetail-shaped cross section which corresponds to but is slightly smaller than said first dovetail-shaped cross section of said connecting passage, and a resilient takeup device mounted on said second keypart and including a takeup member movably mounted on said second keypart and spring-urged outwardly for engagement with one inclined side surface of said connecting passage for eliminating clearance adjacent the opposite inclined side surface of said connecting passage and for causing said jaw member to snug down against said base.

* * * * *